US009004746B2

(12) United States Patent
Beccia

(10) Patent No.: US 9,004,746 B2
(45) Date of Patent: Apr. 14, 2015

(54) TIMEPIECE WHEEL SET WITH PERIPHERAL GUIDING

(75) Inventor: Vincent Beccia, Pully (CH)

(73) Assignee: Blancpain SA, Le Brassus (CH)

( * ) Notice: Subject to any disclaimer, the term of this patent is extended or adjusted under 35 U.S.C. 154(b) by 9 days.

(21) Appl. No.: 13/991,555

(22) PCT Filed: Nov. 22, 2011

(86) PCT No.: PCT/EP2011/070670

§ 371 (c)(1),
(2), (4) Date: Jun. 4, 2013

(87) PCT Pub. No.: WO2012/084382

PCT Pub. Date: Jun. 28, 2012

(65) Prior Publication Data

US 2013/0250740 A1 Sep. 26, 2013

(30) Foreign Application Priority Data

Dec. 20, 2010 (EP) ..... 10195928

(51) Int. Cl.

| | |
|---|---|
| ***G04B 15/00*** | (2006.01) |
| ***G04B 15/14*** | (2006.01) |
| ***G04B 17/06*** | (2006.01) |
| ***G04B 31/012*** | (2006.01) |

(52) U.S. Cl.
CPC ..... *G04B 15/14* (2013.01); *G04B 17/06* (2013.01); *G04B 31/0123* (2013.01)

(58) Field of Classification Search
CPC ..... G04B 31/0123; G04B 15/14
USPC ..... 368/124, 127, 129, 169
See application file for complete search history.

(56) References Cited

U.S. PATENT DOCUMENTS

| | | | | |
|---|---|---|---|---|
| 5,278,807 | A | 1/1994 | Mathys | |
| 5,608,694 | A | 3/1997 | Grimm et al. | |
| 6,409,379 | B1 * | 6/2002 | Gabathuler et al. | 368/150 |

(Continued)

FOREIGN PATENT DOCUMENTS

| | | |
|---|---|---|
| CH | 682 871 B5 | 6/1994 |
| CH | 687 795 A3 | 2/1997 |

(Continued)

OTHER PUBLICATIONS

International Search Report of PCT/EP2011/070670, dated Feb. 23, 2012.

*Primary Examiner* — Amy Cohen Johnson
*Assistant Examiner* — Jason Collins
(74) *Attorney, Agent, or Firm* — Sughrue Mion, PLLC

(57) ABSTRACT

Timepiece wheel set (1) including a first guide surface (2) cooperating with a second guide surface (3) associated with a bridge (50), for pivotally mounting the wheel set (1) relative to the bridge (50) about an axis (D). The first guide surface (2) is a single surface, located on a median plane (P) of said wheel set (1), orthogonal to this axis (D), for holding the wheel set (1) careened or in a cantilever arrangement relative to this bridge (50), and the wheel set (1) is free of any guide arbours on either side of this guide surface (2).This wheel set (1) forms a ball bearing (10) wherein the first guide surface (2) forms an internal raceway (9) for balls (11) and wherein an external ball race (12) mounted on the bridge (50) includes the second guide surface (3) forming an external raceway for the balls (11).

17 Claims, 5 Drawing Sheets

(56) References Cited

U.S. PATENT DOCUMENTS

| | | | | |
|---|---|---|---|---|
| 7,316,504 | B1 * | 1/2008 | Mock et al. | 368/127 |
| 2010/0246338 | A1 | 9/2010 | Calabrese et al. | |

FOREIGN PATENT DOCUMENTS

| | | | |
|---|---|---|---|
| CH | 700 673 | A2 | 9/2010 |
| EP | 1 995 650 | A1 | 11/2008 |

* cited by examiner

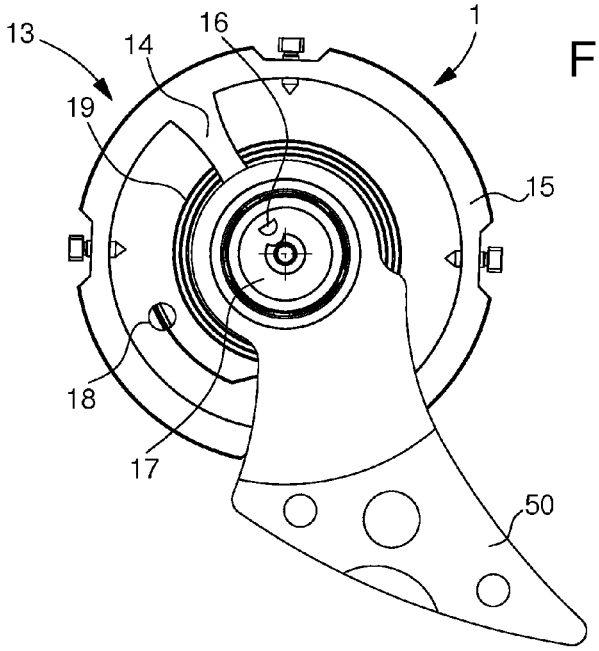
Fig. 9
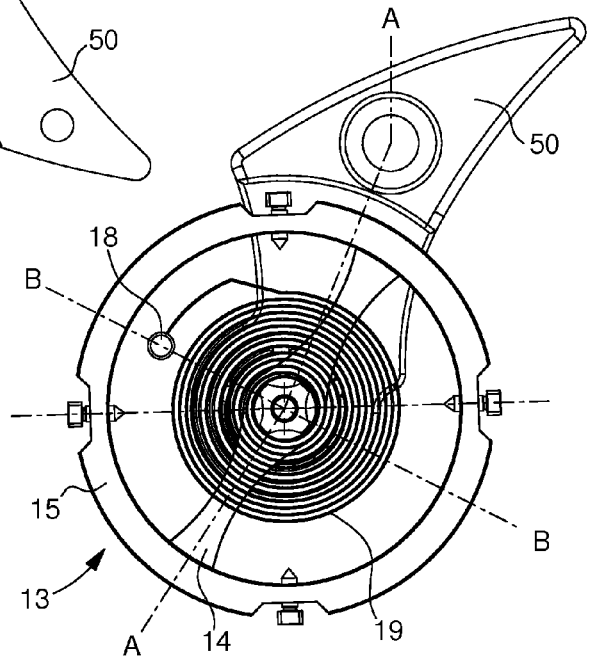
Fig. 10
Fig. 11
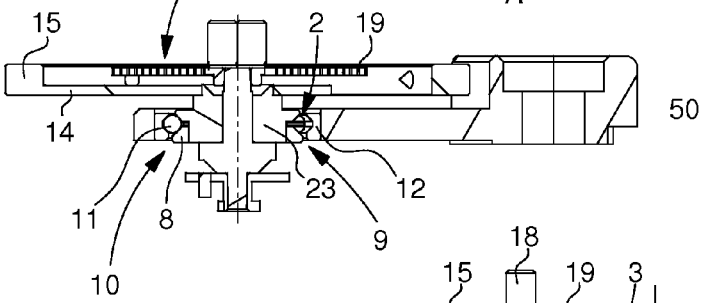
Fig. 12
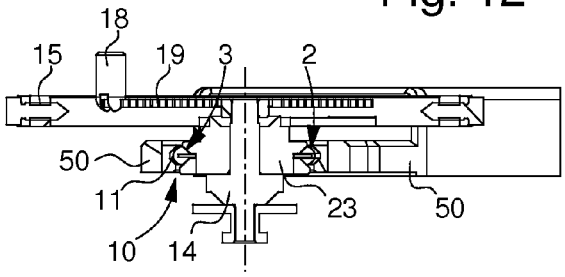

TIMEPIECE WHEEL SET WITH PERIPHERAL GUIDING

CROSS REFERENCE TO RELATED APPLICATIONS

This is a National Stage of International Application No. PCT/EP2011/070670 filed Nov. 22, 2011, claiming priority based on European Patent Application No. 10195928.6filed Dec. 20, 2010, the contents of all of which are incorporated herein by reference in their entirety.

FIELD OF THE INVENTION

The invention concerns a timepiece wheel set, selected from among an oscillator mechanism, an escapement mechanism, a display mechanism, a time-setting mechanism, a calendar mechanism, a chronograph mechanism, a counter mechanism or a flyback mechanism, wherein said wheel set includes a first guide surface arranged to cooperate in a complementary manner, directly or indirectly with a second guide surface associated with a bridge, for pivotably mounting said wheel set relative to said bridge about a pivot axis.

The invention also concerns a timepiece movement including at least one bridge and at least one such wheel set.

The invention also concerns a timepiece including at least one timepiece movement and/or at least one bridge and at least one wheel set of this type.

The invention concerns the field of timepiece mechanisms, and more specifically the field of mechanical watches.

BACKGROUND OF THE INVENTION

Very often, the performance of timepiece movements, or the possibility of housing particular complications or functions are limited by the need to guide the pivoting wheel sets by pivots secured to plates or bridges. This guiding is generally achieved, at least for wheel sets with high angular velocity, via the cooperation, on each side of the wheel set, between an arbour comprised in the wheel set and a jewel comprised in the plate or bridge.

Cantilever arrangements, which would free space at least on one side of the wheel set, to house other components of the movement, are rare, because of the care required for the manufacture thereof, and the high associated manufacturing cost. An example of this is provided by CH Patent No. 682 871 in the name of FREDERIC PIGUET, for manufacturing an ultra-flat movement, wherein all the wheel sets are mounted in a cantilever arrangement on a single plate, each via a ball bearing mounted, on the one hand on the plate and on the other hand on an arbour comprised in the wheel set. In the same Patent, a drum-shaped ratchet surrounds the barrel and is pivoted on the periphery thereof by three rollers each pivoted on a ball bearing, and the barrel is pivoted in the ratchet by means of a ball bearing. This type of assembly greatly improves accessibility to the interior of the movement compared to conventional movements, but the wheel sets are still fitted with arbours of small diameter and great precision is required to fit said arbours in the bearings and axial holding means have to be provided. The axial holding may be achieved by shrinking the arbour on the inner cage of the bearing, which means it cannot be used for wheel sets made of fragile materials such as silicon or similar.

For wheel sets of large dimensions and slow angular velocity, such as tourbillons, karussels or barrels, it is also known to hold on a shoulder of relatively large diameter with a very thick ball bearing, as in CH Patent No. 687 795 in the name of OMEGA, which discloses a tourbillon in a cantilever arrangement supported on its base only by a bearing of this type. A flying karussel like that of EP Patent No. 1 995 650 in the name of BLANCPAIN includes a carriage carried by a wheel set of large dimensions, carried by a ball bearing fixed to a bridge.

The FR patent No. 2 886 995 in the name of SEIKO still discloses a ball bearing device for automatic winding.

However, these applications only concern wheel sets with high inertia, and no alternative to conventional guiding using an arbour and pivot is known for wheel sets with lower inertia, and/or higher angular velocity.

Moreover, it is generally necessary to equip the pivots of the most sensitive members, such as those of the regulating mechanism, with anti-shock devices, which involve considerable expense and require considerable space.

For these regulating mechanisms, it is again a question of reducing the influence of the play of the pivots according to the position of the timepiece in space, which generally leads to different operating parameters according to said position and, in particular to variations in the oscillation amplitude of the balances.

SUMMARY OF THE INVENTION

The invention proposes to overcome the drawbacks of the prior art by proposing a method of guiding wheel sets, in particular timepiece wheel sets with lower inertia and/or higher angular velocity, which guarantees perfect and identical guiding in all positions, very low sensitivity to shocks, and which frees space, in a complicated timepiece, for housing complications without the hindrance of arbours making the insertion of said complication mechanisms difficult.

When, in a preferred but non-limiting application, the invention concerns the guiding of balances, it ensures the regularity of the amplitude of oscillation whatever the position of the balance in space.

The invention therefore concerns a timepiece wheel set, selected from among an oscillator mechanism, an escapement mechanism, a display mechanism, a time-setting mechanism, a striking mechanism, a calendar mechanism, a chronograph mechanism, a counter mechanism or a flyback mechanism, wherein said wheel set comprises a first guide surface arranged to cooperate in a complementary manner, directly or indirectly with a second guide surface associated with a bridge, for pivotably mounting said wheel set relative to said bridge about a pivot axis, said first guide surface is generated by revolution about said pivot axis, is unique and located on a median plane of said wheel set which is substantially orthogonal to said pivot axis, so as to keep said wheel set careened or in a cantilever arrangement relative to said bridge, and wherein said wheel set is guided at a distance from said pivot axis, characterized in that said wheel set includes, on both sides of said median plane, a first means of applying torque relative to said pivot axis and a second means of applying torque relative to said pivot axis, so as to distribute the stresses exerted on said wheel set by said first torque applying means and said second torque applying means on both sides of said first guide surface.

According to another feature of the invention, said first guide surface forms an inner ball bearing raceway.

According to another feature of the invention, with said bridge on the one hand and a plurality of balls on the other hand, said wheel set forms a ball bearing wherein a first guide surface forms an internal raceway for said balls, and an external raceway for said balls is formed by said second guide surface comprised in said bridge or added to said bridge.

According to another feature of the invention, said wheel set is made of silicon or a material derived from MEMS or "LIGA" technologies.

According to another feature of the invention, said wheel set includes a plurality of balls and forms a ball bearing, a first guide surface of which forms an inner raceway for said balls and said wheel set includes an external ball race comprising said second guide surface which forms an external raceway for said balls, said external ball race being arranged to be mounted on said bridge.

The invention further concerns a timepiece movement comprising at least one bridge and at least one such wheel set, characterized in that said at least one bridge includes at least one surface which either forms said second guide surface and is then generated by revolution about said pivot axis D, or is arranged to receive an external ball race comprising said second guide surface centred on said pivot axis D, said second guide surface being arranged to cooperate coaxially with said first guide surface comprised in said wheel set, either directly, or via balls.

According to a feature of the invention, said bridge comprising said second guide surface, and said wheel set including said first guide surface, form, with a plurality of balls inserted and held between said second guide surface and said first guide surface, a ball bearing.

The invention further concerns a timepiece including at least one such timepiece movement, and/or at least one bridge and at least one such wheel set, characterized in that said at least one bridge comprises at least one surface which either forms said second guide surface and is generated by revolution about said pivot axis, or is arranged to receive an external ball race comprising said second guide surface centred on said pivot axis, said second guide surface being arranged to cooperate coaxially with said first guide surface comprised in said at least one wheel set, either directly or via balls.

When, in a preferred but non-limiting application, the invention concerns the guiding of balances, it ensures the regularity of the amplitude of oscillation whatever the position of the balance in space.

BRIEF DESCRIPTION OF THE DRAWINGS

Other features and advantages of the invention will appear upon reading the following detailed description, with reference to the annexed drawings, in which:

FIG. 9 shows a schematic bottom view of a wheel set, in this case a timepiece sprung balance, wherein a sleeve fixed onto the balance forms an inner guide surface of a ball bearing, the external ball race of which is driven into a bridge, said sprung balance being mounted in a cantilever manner in said bridge.

FIG. 10 shows a schematic top view of the wheel set of FIG. 9.

FIG. 11 shows a schematic cross-section along line AA of FIG. 10 of the wheel set of FIG. 9 in an assembly position with the external ball race of the bearing driven into the bridge.

FIG. 12 shows a schematic cross-section of the wheel set of FIG. 9 along line BB of FIG. 10.

DETAILED DESCRIPTION OF PREFERRED EMBODIMENTS

Figure 1:
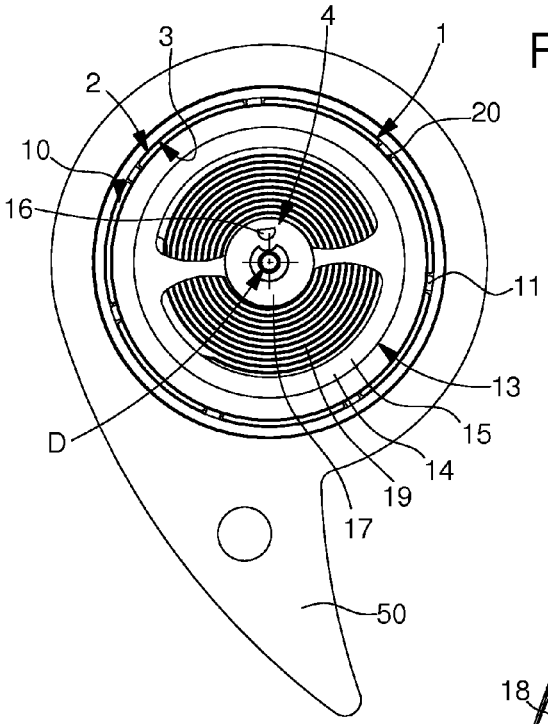
FIG. 1 shows a schematic bottom view of a wheel set, in this case a timepiece sprung balance, wherein the rim of the balance forms an inner guide surface of a ball bearing, the external ball race of which is driven into a bridge, said sprung balance being careened in said bridge.
Figure 2:
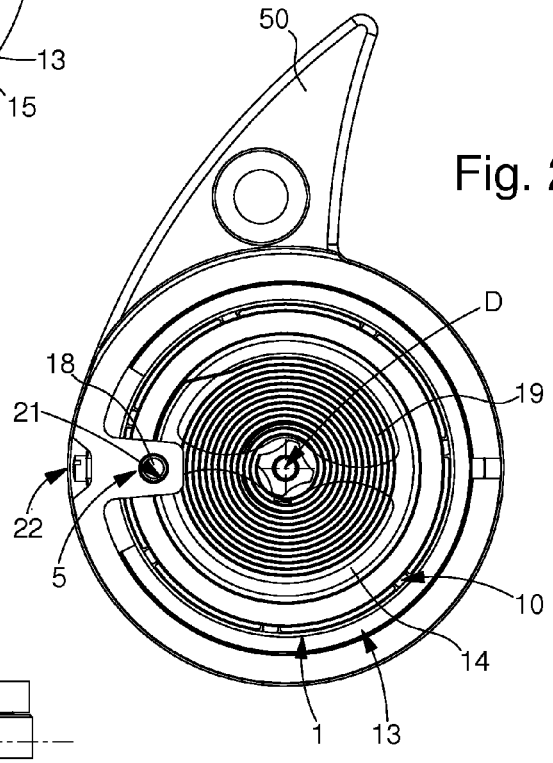
FIG. 2 shows a schematic top view of the wheel set of FIG. 1.
Figure 3:
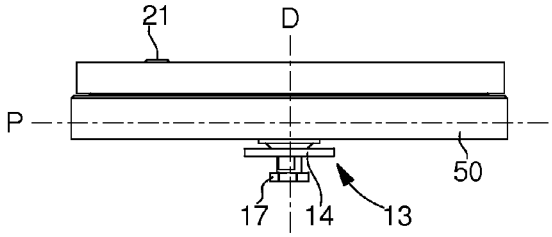
FIG. 3 shows a schematic elevation of the wheel set of FIG. 1.
Figure 4:
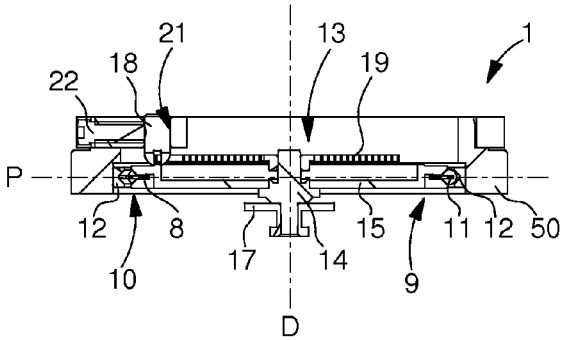
FIG. 4 shows a schematic cross-section through the pivot axis of the wheel set of FIGS. 1 to 3, in an assembly position with the external ball race of the bearing driven into the bridge.

The invention concerns the field of timepiece mechanisms, and more specifically the field of mechanical watches.

As seen in the Figures, the invention concerns a timepiece wheel set 1. This wheel set 1 is of the type with lower inertia and/or greater angular velocity and is selected from among an oscillator mechanism, an escapement mechanism, a display mechanism, a time-setting mechanism, a striking mechanism, a calendar mechanism, a chronograph mechanism, a counter mechanism or a flyback mechanism. This is by no means an exhaustive list of the possibilities of the invention, but sets out the preferred applications. Wheel set 1 is arranged to pivot about a pivot axis D.

According to the invention, wheel set 1 includes a first guide surface 2, which is arranged to cooperate in a complementary manner, directly or indirectly, with a second guide surface 3 associated with a bridge 50 for pivotally mounting wheel set 1 relative to bridge 50 about a pivot axis D.

According to the invention, the first guide surface 2 is generated by revolution about pivot axis D, it is the only guide surface and is located in a median plane P of wheel set 1. This median plane P is substantially orthogonal to said pivot axis D, so as to hold said wheel set 1 flush with or overhanging bridge 50.

Advantageously, wheel set 1 is guided at a distance from pivot axis D. Wheel set 1 has no guide arbour in the direction of pivot axis D on either side of guide surface 2, which means the wheel set can be used in ultra-flat movements and the external space on both sides thereof can be used for other purposes.

Preferably, the first continuous guide surface 2 is on the largest possible diameter of revolution of wheel set 1 about pivot axis D, and preferably at the periphery thereof, i.e. in the area the furthest away radially from pivot axis D.

According to an essential feature of the invention, the mechanical torque applying means are distributed on both sides of a median plane, on which the guide surface is located.

Thus, in a preferred application, wheel set 1 includes, on either side of this median plane P, a first means 4 of applying a first torque relative to pivot axis D and a second means 5 of applying a second torque relative to pivot axis D, so as to distribute the stresses exerted on wheel set 1 by said first torque applying means 4 and second torque applying means 5 on both sides of the first guide surface 2.

Figure 5:
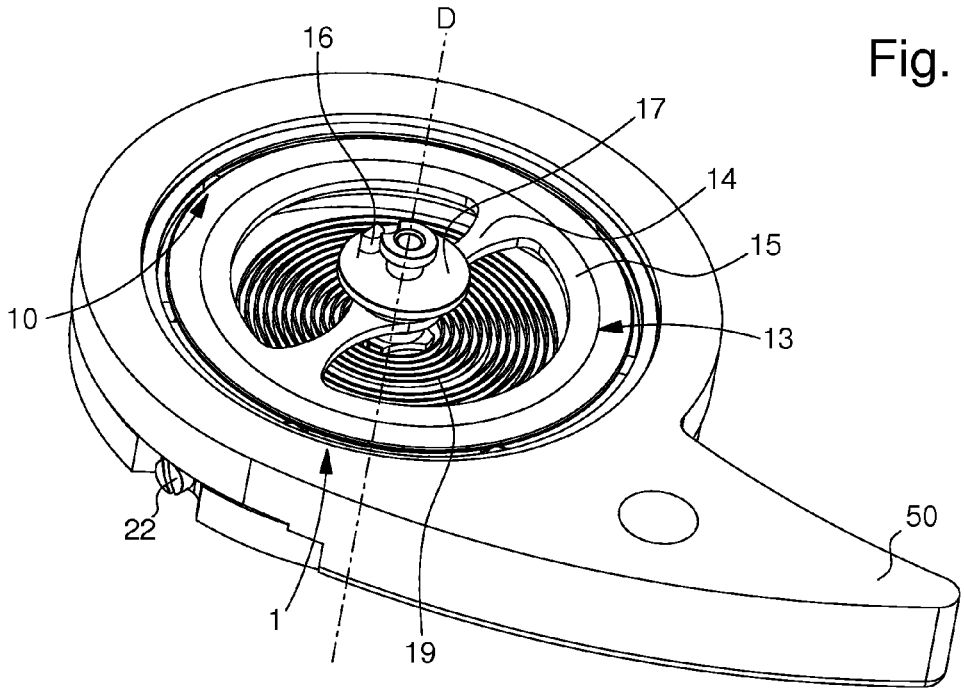
FIG. 5 shows a schematic, perspective, top view of the wheel set of FIG. 1.
Figure 6:
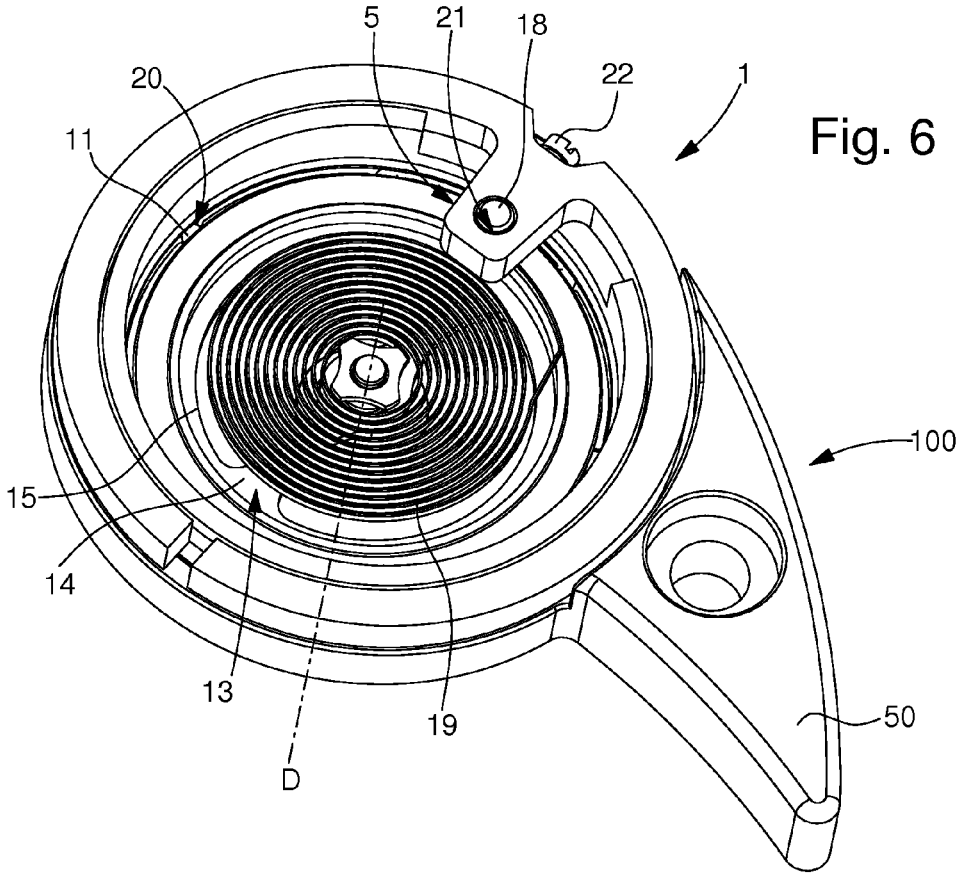
FIG. 6 shows a schematic, perspective, bottom view of the wheel set of FIG. 1.
Figure 7:
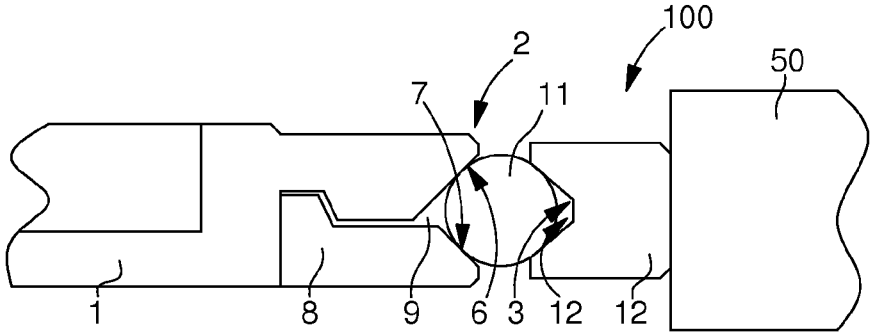
FIG. 7 shows, in a schematic cross-section of a plane passing through the pivot axis, a detail of the periphery of a wheel set according to a variant of the invention.
Figure 8:
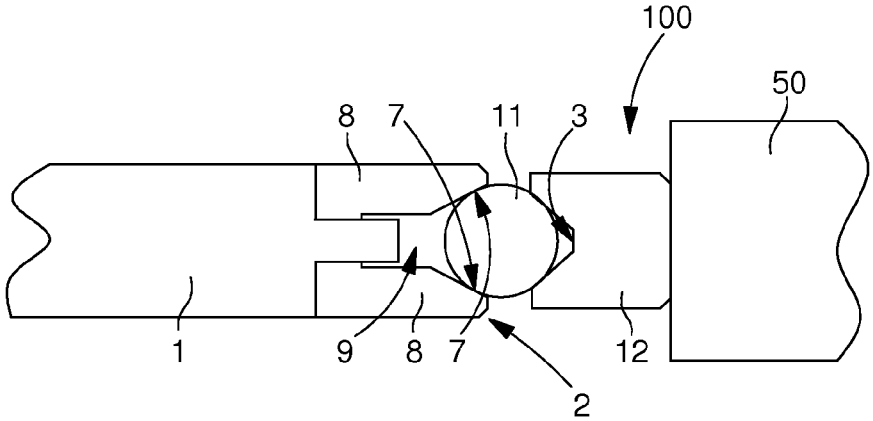
FIG. 8 shows a detail of another embodiment of the invention, in a similar manner to FIG. 7.
Figure 13:
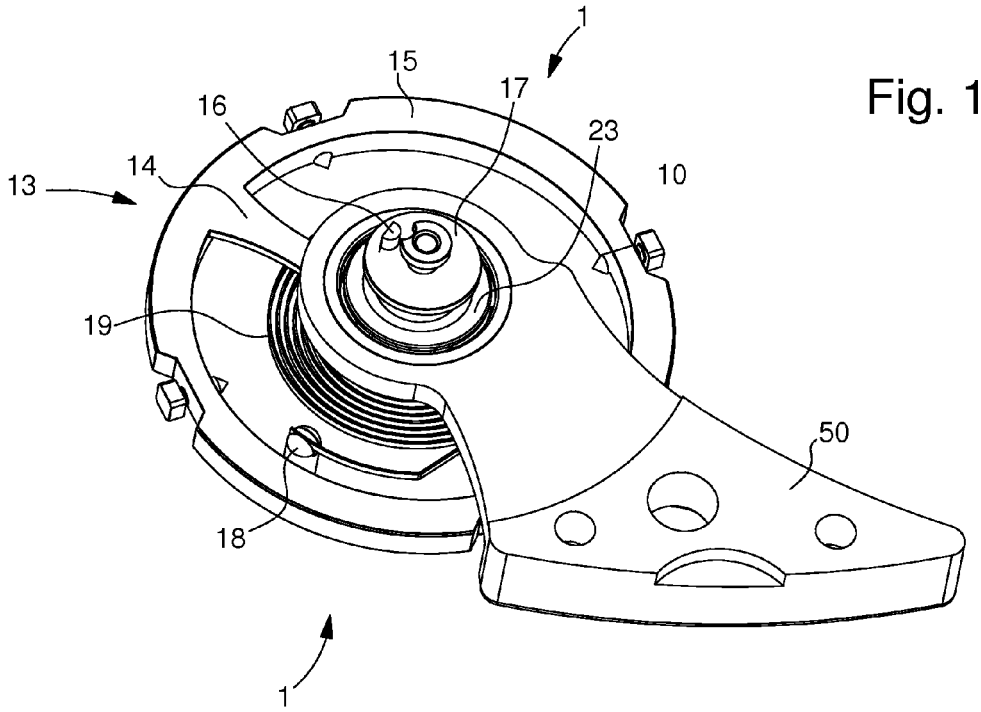
FIG. 13 shows a schematic, perspective, top view of the wheel set of FIG. 9.
Figure 14:
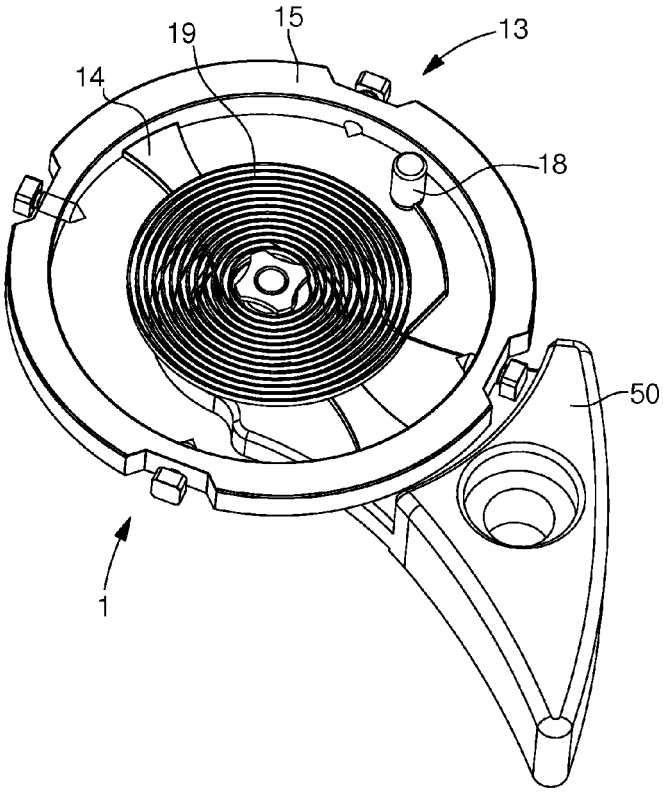
FIG. 14 shows a schematic, perspective, bottom view of the wheel set of FIG. 9.

As seen in FIGS. 5 and 6, first guide surface 2 is preferably formed by at least one peripheral guide surface 6 comprised in wheel set 1 and/or by at least one raceway surface 7 comprised in at least one raceway 8 added onto wheel set 1. Preferably, as seen in FIG. 7, a peripheral surface 6 is integrated in wheel set 1, and a removable raceway 8 is added thereto, which allow intermediate components to be inserted, such as balls 11 in this case. The first guide surface 2 may also be formed by the combination of two raceway 8 added onto wheel set 1, as seen in FIG. 8.

Naturally, a number of raceways 8 higher than 2 can be envisaged, but in practice it is preferably limited to two, essentially for reasons of space and production costs.

Preferably, according to the invention, the first guide surface 2 forms an inner raceway 9 for balls 11.

According to the invention, timepiece wheel set 1 forms, alone or with bridge 50, a ball bearing 10.

In a first version, wheel set 1 forms, with said bridge 50 on the one hand and a plurality of balls 11 on the other hand, a ball bearing 10 wherein the first guide surface 2 forms an inner raceway for balls 11, and wherein an external raceway for balls 11 is formed by the second guide surface 3 comprised in bridge 50, or which is added to bridge 50, for example on a ring or similar. In an advantageous variant of this first version, wheel set 1 is a single-piece. Preferably, it is made of silicon or in a material derived from MEMS or "LIGA" technologies, which allows a combination of complex geometry, very precise tolerances and elasticity in some areas thereof. These materials are of definite interest for making, in particular, wheel sets having low inertia and high angular velocity, such as balances and suchlike. The invention provides such wheel sets with even greater flexibility of use, by dispensing with the requirement for guide arbours on the pivot axis in the design thereof. The combination of carrened mounting or cantilever mounting proposed by the invention with these types of materials thus proves particularly advantageous.

In a second version, which is preferred since it is more versatile; wheel set 1 includes a plurality of balls 11 and forms a ball bearing 10 wherein the first guide surface 2 forms an internal raceway 9 for balls 11. Wheel set 1 then includes an external ball race 12, which includes second guide surface 3, which forms an external raceway for balls 11, said external ball race 12 being arranged to be mounted on bridge 50. Wheel set 1 may thus form a sub-assembly ready for assembly on a bridge 50. Advantageously, external ball race 12 is then made of a non-fragile material, in particular a metal alloy, which means it can be driven into a housing or bore in bridge 50. Preferably, in this second version, wheel set 1 is formed of this external ball race 12, the plurality of balls 11 and a single-piece body which is made, as above, of silicon or in a material derived from MEMS or "LIGA" technologies.

A mixed embodiment is also possible with a single-piece silicon or similar wheel set body and the variant with one or several raceways 8 added at the periphery 2 of wheel set 1 is advantageous if a fragile or shock sensitive material is used for the body of wheel set 1.

In a particularly advantageous application of the invention, wheel set 1 is a sprung balance 13 or a balance 14 comprising a rim 15, and the first guide surface 2 is at the periphery of said rim 15 and preferably over the largest diameter of said rim 15 relative to pivot axis D. The first torque applying means 4 is formed by an impulse pin 16 of roller 17 comprised in sprung balance 13 or balance 14 on a first side of rim 15, and the second torque applying means 5 is formed by a balance spring stud 18 when wheel set 1 is a sprung balance 13 or by a spring 19 when wheel set 1 is a balance 14. Preferably, the first guide surface 2 is radially directed towards the opposite side to pivot axis D.

The Figures illustrate a wheel set 1 formed by a sprung balance 13 comprising a balance 14 equipped with a roller 17 and an impulse pin 16 so as to cooperate with an escapement mechanism and a balance spring 19 pinned up in a conventional manner to balance 14 on the one hand, and on the other hand, to a balance spring stud 18 fixed to a plate or bridge 50, hereinafter referred to as a "bridge".

The invention also concerns a timepiece movement 100 including at least one bridge 50 and at least one wheel set 1. According to the invention, this bridge 50 includes at least one surface which, either forms the second guide surface 3 and is then generated by revolution about pivot axis D, or is arranged to receive an external ball race 12 comprising second guide surface 3 centred on pivot axis D, wherein said second guide surface 3 is arranged to cooperate coaxially with the first guide surface 2 comprised in said wheel set 1, either directly or indirectly via balls 11.

Preferably, as seen in the Figures, in this movement 100, bridge 50 including second guide surface 3 and wheel set 1 including first guide surface 2 form a ball bearing 10 with a plurality of balls 11 inserted and held between second guide surface 3 and first guide surface 2, Balls 11 are preferably held at a distance from each other by spacer means 20, such as a ball bearing housing or a plurality of housings, comprised in bridge 50 and/or wheel set 1 and/or movement 100.

In a preferred application shown in the Figures, movement 100 includes a sprung balance or a balance, and bridge 50 includes a housing 21 for a balance spring stud 18 for attaching a spring and a means 22 of securing and/or adjusting the position of balance spring stud 18, or includes a means of securing a secondary bridge comprising a housing 21 for a balance spring stud 18 and a securing and/or position adjusting means 22. The latter means may be made in the form of a screw abutting on one or several balance spring stud surfaces to adjust the position thereof, for example while pivoting in the case of a faceted stud, or vertically, In the application shown in FIGS. 1 to 6, movement 100 includes a wheel set 1 which is a sprung balance 13 careened in a bridge 50 and includes a spring 19 secured to a balance spring stud 18, which is in turn fixed to bridge 50 or to a second bridge fixed to said bridge 50. The invention therefore makes it possible to make a finished sub-assembly comprising a bridge, balance spring stud, sprung balances, a means for guiding the pivoting of the sprung balance, which is ready to be assembled on another bridge or another plate, thereby rationalising mounting and adjustments and simplifying the final assembly. The invention also makes after sales service easier since it may be sufficient simply to change a unit formed of this type of sub-assembly.

In the application shown in FIGS. 9 to 14, movement 100 comprises a wheel set 1 which is an flying balance which is not entirely careened but guided over an intermediate diameter, at a sleeve 23 comprised in balance 14 or secured thereto, said sleeve 23 then carries the first continuous guide surface 2. This arrangement enables existing balances to be easily used, since they can be modified by removing the guide arbours and fitting this type of sleeve 23 using driving in, bonding or a similar method.

In a particular embodiment, the first continuous guide surface 2 is carried by a sleeve 23 comprised in balance 14, or a balance 14 comprised in a sprung balance 13, or which is secured to balance 14, at an intermediate diameter which is smaller than the largest diameter of rim 15 relative to pivot axis D.

The invention also concerns a timepiece 1000 including at least one timepiece movement 100 of this type, and/or at least one bridge 50 and at least one wheel set 1 of this type.

In this timepiece, such as a watch, at least one bridge 50 comprises at least one surface which either forms second guide surface 3 and is then generated by revolution about pivot axis D, or is arranged to receive an external ball race 12 comprising said second guide surface 3 centred on pivot axis D, the second guide surface 3 being arranged to cooperate coaxially with first guide surface 2 comprised in wheel set 1, either directly or via balls 11.

In another embodiment, the abutment between first guide surface 2 and second guide surface 3 may be achieved directly, on antagonistic surfaces, but it is difficult to ensure a sufficiently low level of friction loss and still remain compatible with the great longevity required by a timepiece.

In short, through this innovating design, the invention ensures, for wheel sets such as balances, perfect and identical guiding in all positions, and very low shock sensitivity.

The careened or flying arrangement of the wheel set means guide arbours and the corresponding pivots can be omitted and frees space in a complicated timepiece for housing complications without the hindrance of arbours making it difficult to insert these complication mechanisms. Moreover, lubrication problems are reduced, owing to the choice of guide members made in the form of ball bearings.

Combination with wheel sets made of silicon or using MEMS or "LIGA" technologies also reduces the number of components and their inertia, increases sizing precision and thus makes the components easier to adjust.

The invention further produces oscillator sub-assemblies which are ready to be assembled, pre-adjusted and ready for use.

The invention claimed is:

1. A timepiece wheel set, selected from among an oscillator mechanism or an escapement mechanism, wherein said wheel set comprises a first guide surface arranged to cooperate in a complementary manner, directly or indirectly with a second guide surface associated with a bridge, for pivotably mounting said wheel set relative to said bridge about a pivot axis, said first guide surface encircles said pivot axis, is unique and located on a median plane of said wheel set said median plane which is substantially orthogonal to said pivot axis, so as to keep said wheel set careened or in a cantilever arrangement relative to said bridge, and wherein said wheel set is guided at a distance from said pivot axis, wherein said wheel set includes, on a first side of said median plane a first means of applying torque relative to said pivot axis and, on a second side of said median plane a second means of applying torque relative to said pivot axis, so as to distribute the stresses exerted on said wheel set at said first torque applying means and said second torque applying means on both sides of said first guide surface.

2. The timepiece wheel set according to claim 1, wherein said first guide surface is formed by at least one peripheral guide surface comprised in said wheel set, and/or by at least one raceway surface comprised in at least one raceway added to said wheel set.

3. The timepiece wheel set according to claim 2, wherein a peripheral guide surface is integrated in said wheel set and wherein a raceway added to said wheel set can be removed to allow the insertion of balls.

4. The timepiece wheel set according to claim 1, wherein said first guide surface is formed by a combination of two raceways added to said wheel set.

5. The timepiece wheel set according to claim 1, wherein said second guide surface forms an external raceway for receiving balls of a ball bearing, and wherein said first guide surface forms an internal raceway for receiving said balls of said ball bearing.

6. The timepiece wheel set according to claim 5, wherein said wheel set is single-piece and made of silicon or in a material derived from MEMS or "LIGA" technologies.

7. The timepiece wheel set according to claim 5, wherein said wheel set includes a plurality of balls and forms a ball bearing wherein said first guide surface forms an internal raceway for said balls and wherein said wheel set comprises an external ball race including said second guide surface which forms an external raceway for said balls, said external ball race being arranged to be mounted on said bridge.

8. The timepiece wheel set according to claim 1, wherein said first guide surface is continuous and is at the periphery of the wheel set.

9. The timepiece wheel set according to claim 1, wherein said wheel set is a sprung balance or a balance comprising a rim, and wherein said first guide surface is at the periphery of said rim.

10. The timepiece wheel set according to claim 9, wherein said wheel set is a sprung balance, and wherein said first means of applying torque is formed by an impulse pin of a roller comprised in said sprung balance or balance on a first side of said rim, and wherein said second means of applying torque is formed by a balance spring stud when said wheel set is a sprung balance or by a balance spring when said wheel set is a balance.

11. The timepiece wheel set according to claim 9, wherein said first guide surface is continuous and is carried by a sleeve comprised in said balance or a balance comprised in said sprung balance, or which is fixed to said balance, on an intermediate diameter which is smaller than a largest diameter of said rim relative to said pivot axis.

12. The timepiece movement including at least one bridge and at least one wheel set according to claim 1, wherein said at least one bridge comprises at least one surface which, either forms said second guide surface, or is arranged to receive an external ball race comprising said second guide surface centered on said pivot axis, said second guide surface being arranged to cooperate coaxially with said first guide surface comprised in said at least one wheel set, either directly or via balls.

13. A movement according to claim 12, wherein said bridge comprising said second guide surface and said wheel set comprising said first guide surface form a ball bearing with a plurality of balls inserted and held between said second guide surface and said first guide surface.

14. The movement according to claim 13, wherein said balls are held at a distance from each other by a spacer means comprised in said bridge and/or said wheel set and/or said movement.

15. The movement according to claim 12, wherein said at least one bridge includes a housing for a balance spring stud for attaching a balance spring and a means of securing and/or adjusting the position of said stud, or comprises a means of securing a secondary bridge comprising a housing for a stud and a securing and/or position adjusting means.

16. The movement according to claim 12, wherein said wheel set is a sprung balance careened in said bridge and includes a balance spring fixed to a balance spring stud which is in turn secured to said bridge or to a secondary bridge secured to said bridge.

17. A timepiece including at least one timepiece movement according to claim 12 and/or at least one bridge and at least one wheel set according to claim 1, wherein said at least one bridge includes at least one surface which either forms said second guide surface, or is arranged to receive an external ball race comprising said second guide surface centered on said pivot axis, said second guide surface being arranged to cooperate coaxially with said first guide surface comprised in said at least one wheel set either directly or via balls.

* * * * *